US006905440B2

(12) United States Patent
Heppert

(10) Patent No.: US 6,905,440 B2
(45) Date of Patent: Jun. 14, 2005

(54) ELECTRO-MECHANICAL SYSTEM FOR MOTIVATING EXERCISE ACTIVITY

(76) Inventor: Mike Heppert, 2516 Waco St., Richmond, VA (US) 23294

( * ) Notice: Subject to any disclaimer, the term of this patent is extended or adjusted under 35 U.S.C. 154(b) by 19 days.

(21) Appl. No.: 10/330,657

(22) Filed: Dec. 30, 2002

(65) Prior Publication Data

US 2004/0127334 A1 Jul. 1, 2004

(51) Int. Cl.[7] ..... A63B 21/00

(52) U.S. Cl. ..... 482/2; 482/8; 482/902; 463/7

(58) Field of Search ..... 482/1–9, 51, 54, 482/57, 900–902; 463/1, 7; 348/730

(56) References Cited

U.S. PATENT DOCUMENTS 4,298,893 A * 11/1981 Holmes ..... 348/730
4,389,047 A * 6/1983 Hall ..... 482/2
4,542,897 A * 9/1985 Melton et al. ..... 463/7
4,616,823 A * 10/1986 Yang ..... 482/57
5,142,358 A * 8/1992 Jason ..... 348/61
6,179,746 B1 1/2001 Delman

* cited by examiner

*Primary Examiner*—Glenn E. Richman
(74) *Attorney, Agent, or Firm*—Norman B. Rainer

(57) ABSTRACT

An exercise motivating system which rewards the exerciser with allowable TV viewing time includes a component interactive with an exercise modality to generate a responsive signal proportionate to the amount of exertion or work done. The responsive signal is received by an accumulating component which converts it to a stored control medium. A control module is interposed between a source of household electrical current and an electrical appliance such as a TV set. The control module physically couples with the accumulating component and processes the stored control medium in a manner to operate the appliance for a time duration proportionate to the amount of exercise effort recorded by the accumulating component.

5 Claims, 1 Drawing Sheet

ELECTRO-MECHANICAL SYSTEM FOR MOTIVATING EXERCISE ACTIVITY

BACKGROUND OF THE INVENTION

1. Field of the Invention

This invention concerns a system for motivating individuals to perceive the advantages of exercise activity, and more particularly relates to apparatus which requires that exercise activity be performed as a prerequisite for engagement in sedentary activity.

2. Description of the Prior Art

It is well established that physical fitness, developed by way of a regular regimen of exercise activity is beneficial from a health standpoint. Unfortunately, children and young adults often avoid exercise for various reasons, and instead spend long hours in sedentary activity such as watching TV, playing video games, or engaging in other computer-related activities. Such electrically operated devices are of commonplace occurrence and readily accessible in most households.

Several types of exercise equipment are available for household use. Such equipment typically requires repetitive movement, and includes stationary bicycles, treadmills and rowing machines. Many individuals purchase such exercise devices, then do not use them on a regular basis because of a lack of suitable motivation.

Various devices and systems have been proposed for motivating children and adolescents to utilize home exercise equipment. The basic principle of such systems generally is to cause the individual to earn by way of exercise the privilege of participating in sedentary activities such as watching TV. Most such systems reward the exerciser by way of switching devices which activate a TV set, computer or other electrical appliance.

An early approach to the coupling of exercise activity with the operation of an electrical appliance is disclosed in U.S. Pat. No. 4,298,893 to Hohnes in which an exercise bicycle is caused to generate sufficient electricity to power a television set. Although a simple concept, it is unlikely that a generator driven by a bicycle can produce sufficient electrical power at a sustained uniform rate to operate a TV set.

U.S. Pat. No. 6,179,746 to Delman discloses a system wherein a bicycle, when operated at a predetermined intensity level, enables the exercising person to watch a TV set. This system requires that the TV set be directly in front of the bicycle for viewing, and requires an electrical connection between the bicycle and the TV set. Because Delman's system operates only during exercise, it does not permit use of a computer, video game or any other appliance that requires use of the hands or other specialized physical or mental involvement.

Other systems which reward the exerciser by permitting TV viewing or video game operation during exercise at a predetermined intensity are disclosed in U.S. Pat. Nos. 4,542,897; 5,591,104; 4,976,435; 4,512,567; 4,637,605; 5,001,632; 5,362,069; and 5,839,990.

Many of the aforesaid prior systems involve complex, expensive components. It should also be noted that popular exercise routines on stationary exercise bicycles involve varied intensity levels which simulate an outdoor bicycle path or road having occasional hills. Such varied intensity routine not only adds interest to the exercise activity, but has beneficial physiological consequences. None of the prior systems provide credit to the exerciser for periods of low intensity exertion, or for the total amount of exertion, as may best be expressed by calories burned or cumulative effort as related to total heart rate activity.

Prior systems cannot provide a cumulative benefit for two or more exercise sessions. Such prior systems, by requiring that the reward for the exertion be limited to the watching of TV during exercising and in close proximity to the bicycle, may dampen a child's enthusiasm for the activity. Also, prior systems are dependent upon the use of indoor exercise devices such as bicycles and treadmills that have rotatively moving components which can be coupled to an electrical generator that produces an electrical current proportional to the rate of rotation of said moving component. The prior systems cannot accommodate outdoor exercise activities such as running, biking, rowing, skating, skiing, etc.

It is accordingly an object of the present invention to provide an exercise motivating system that rewards an exercising person by permitting operation of an electrical appliance for a duration of time proportionate to accumulated measured exertion in exercise activity.

It is another object of this invention to provide an exercise motivating system as in the foregoing object wherein said electrical appliance may be remote from the site of said exercise activity.

It is a further object of the present invention to provide an exercise motivating system of the aforesaid nature wherein said electrical appliance may be operated at a time subsequent to said exercise activity.

It is yet another object of this invention to provide an exercise motivating system of the aforesaid nature having simple components amenable to low cost manufacture and installation.

These objects and other objects and advantages of the invention will be apparent from the following description.

SUMMARY OF THE INVENTION

The above and other beneficial objects and advantages are accomplished in accordance with the present invention by an exercise motivating system interactive with an appliance which operates on household electrical current, said system comprising:

1. generator means responsive to an exercise activity to generate a signal in the form of electrical current or digital information proportionate to the cumulative amount of exertion applied in said activity,
2. accumulator means for receiving said generated signal and converting it to a stored control medium, and
3. a control module interposed between a source of household electrical current and an appliance operable on said current and adapted to physically couple with said accumulator means, said control module adapted to receive and process said stored control medium in a manner to operate said appliance for a time duration proportionate to said stored control medium.

In one embodiment, the exercise activity involves an indoor exercise apparatus having a component that undergoes rotary motion, such as the wheel of a bicycle or the trunnion shafts of a treadmill. In such embodiment, said generator means as an electrical generator, said responsive signal is an electrical current, said accumulator means is a rechargeable storage cell battery, and said stored control medium is an electrical charge. Alternatively, the generator means may be an electronic component of an exercise apparatus, and adapted to produce an output signal in the form of a heart rate, or accumulated calories burned based upon resistance level, rate of motion, and duration of exercise. An example of such apparatus is the Lifecycle stationary bicycle, manufactured by Life Fitness, Inc. of Irvine, Calif. Still another example of generator means is a monitor of the type generally used in running or other exercise modalities for producing a digital read out of heart rate. In such instances, the generated signal is digital information, and the accumulator means is a conventional tape, disc or computer chip device for recording and storing digital signals in the form of instructional information.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
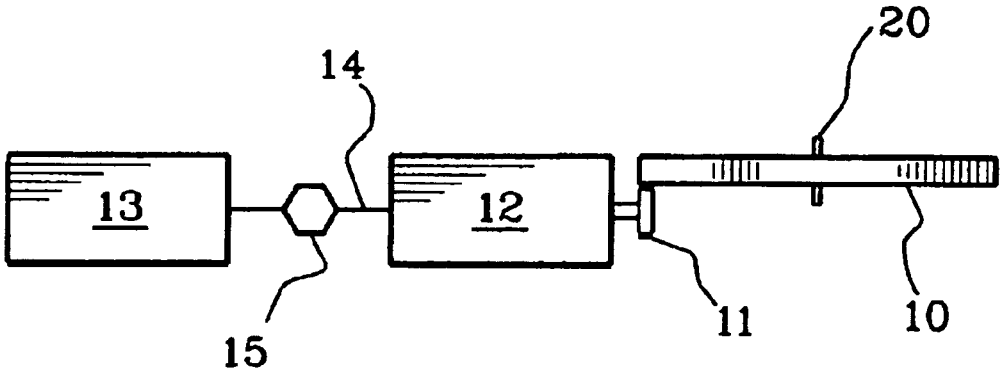
FIG. 1 is a schematic view showing an embodiment of equipment components associated with an exercise apparatus employed in the exercise motivating system of the present invention.
Figure 2:
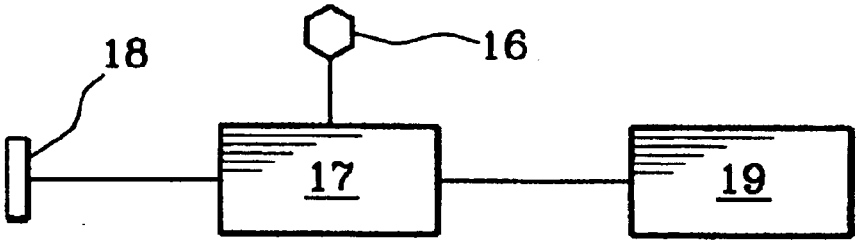
FIG. 2 is a schematic view showing an embodiment of equipment components associated with an electrical appliance involved in the exercise motivating system of this invention.

Referring now to FIGS. 1 and 2, an embodiment of components of the exercise motivating system of the present invention is shown comprised of a rotating member such as wheel 10 of a conventional stationary exercise bicycle rotatable upon axle 20 and mechanically connected with the drive wheel 11 of generator 12.

Accumulator means, in the form of rechargeable storage battery 13 is joined by way of electrical conductor wire 14 and detachment clamp 15 to generator 12. Once detached from said generator, battery 13 or comparable digital information storage device is adapted to connect via clamp 15 to the input connector 16 of control module 17 which is electrically interposed between a household electrical wall receptacle 18 and an appliance such as TV set 19 which is operated on electrical current supplied from receptacle 18.

Drive wheel 11 may have a rubber perimeter adapted to frictionally contact the side surface of bicycle wheel 10 without slippage. A suitable mounting bracket may be employed to mount the generator in secure engagement with wheel 10. Generator 12 is designed to provide a storable direct current or other electrical signal output. In some embodiments, a transmission mechanism may be employed to couple the generator to the intensity level setting of the exercise apparatus, whereby the storable electrical output produced by the generator will be proportionate to the exertion level or work performed on the exercise apparatus. In the several embodiments of this invention, the generator will be programmed to produce a response signal only when the exerciser's exertion heart rate is between about 40% and 80% of maximum capacity, as determined by standardized charts that accompany most current exercise equipment, said maximum heart rate being age-dependent. By virtue of such heart rate criteria, the exerciser will receive no exercise credit, in the form of a response signal from the generator, when he is at rest, and there is no incentive to exercise at an unhealthy heart rate for the purpose of generating greater credit for exercising.

Storage battery 13, when employed as the accumulator means, is of the rechargeable type, and may, for example employ nickel hydride, lithium, silver or nickel/cadmium chemical components. The battery is further characterized in being able to accept a charge at varied voltages, and is compatible with the voltage range of the output from the generator. The accumulator means may alternatively be a tape or disc or computer chip device interactive with a generator component that outputs a response signal in the form of a digitized stream of information. The response signal, which may be indicative of the number or rate of rotations or oscillations of a moving component of an exercise apparatus, or heart beat rate, or accumulated calories burned is recorded as stored computer-readable information in the accumulator means. The accumulator means, for example battery 13, is connected to said generator means by a lock-and-key configuration incorporated into clamp 15, whereby the battery will not accept an input response signal from any unauthorized source.

The clamp 15 of the battery and the input connector 16 of control module also have a lock-and-key configuration whereby only the output from battery 15 can activate control module 17. Any other battery, or source of D.C. voltage or computerized data would not communicate with said control module without proper lock-and-key connectivity.

Control module 17 may employ the principle of a solenoid-type on/off switch or electronic control module wherein D.C. current from battery 13 maintains a switch in a closed state, thereby connecting TV set 19 or other appliance to household electrical current such as 110 volt A.C. supplied from wall receptacle 18. When the stored control medium, such as D.C. current from battery 13, becomes depleted, the solenoid-type switch or control module will open, thereby disconnecting current from said wall receptacle.

Control module 17 is secured to TV set 19 in a manner preventing bypass by an unauthorized electrical conductor communicating directly to the TV set from another source of household electrical current.

By virtue of the aforesaid components and their manner of interaction, the exercising person can accumulate or "bank" credit for exercise activity, and such "credit" can be spent at any time and on any electrical appliance compatible with this system, regardless of location within the house or within another, similarly equipped house.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An exercise motivating system interactive with an appliance which operates on household electrical current, said system comprising:

A. generator means responsive to an exercise activity to generate a signal proportionate to the amount of exertion applied by an exerciser in said activity, said signal being a stream of digital information, B. accumulator means removably associated with said generator means for receiving said generated signal and converting it to a stored control medium as instructional information, said removable association including a lock and key configuration which thwarts unauthorized input to said accumulator means, and C. a control module interposed between a source of household electrical current and an appliance operable on said current and adapted to physically couple with said accumulator means, said control module adapted to receive and process instructional information in a manner to operate said appliance for a time duration proportionate to said amount of exercise exertion.

2. The system of claim 1 wherein said exercise activity involves use of an apparatus having a component that undergoes rotary motion.

3. The system of claim 1 wherein the manner of physical coupling of said accumulator means with said control module includes a lock-and-key configuration.

4. The system of claim 1 wherein said control module is secured to said appliance in a manner preventing bypass by an unauthorized electrical conductor communicating directly to said appliance from said household electrical current.

5. An exercise motivating system interactive with an appliance which operates on household electrical current, said system comprising:

A. generator means responsive to an exercise activity to generate a signal proportionate to the amount of exertion applied by an exerciser in said activity, said signal being a stream of digital information produced only when the exerciser's heart rate is between 40% and 80% of maximum capacity, B. accumulator means removably associated with said generator means f or receiving said generated signal and converting it to a stored control medium, as instructional information, said removable association including a lock and key configuration which thwarts unauthorized input to said accumulator means, and C. a control module interposed between a source of household electrical current and an appliance operable on said current and adapted to physically couple with said accumulator means, said control module adapted to receive and process instructional information in a manner to operate said appliance for a time duration proportionate to said amount of exercise exertion.

* * * * *